United States Patent [19]

Zedalis et al.

[11] Patent Number: 4,869,751

[45] Date of Patent: Sep. 26, 1989

[54] THERMOMECHANICAL PROCESSING OF RAPIDLY SOLIDIFIED HIGH TEMPERATURE AL-BASE ALLOYS

[75] Inventors: Michael S. Zedalis, Randolph, N.J.; Paul S. Gilman, Suffern, N.Y.; Derek Raybould, Denville, N.J.

[73] Assignee: Allied-Signal Inc., Morris Township, Morris County, N.J.

[21] Appl. No.: 181,798

[22] Filed: Apr. 15, 1988

[51] Int. Cl.[4] ..... B22F 1/00

[52] U.S. Cl. ..... 75/249; 419/67; 419/69

[58] Field of Search ..... 419/67, 69; 75/249

[56] References Cited

U.S. PATENT DOCUMENTS 4,765,959 8/1988 Das et al. ..... 75/249

4,770,848 9/1988 Ghosh ..... 75/249

*Primary Examiner*—Stephen J. Lechert, Jr.

*Attorney, Agent, or Firm*—Ernest D. Buff; Gerhard H. Fuchs

[57] ABSTRACT

A dispersion strengthened, non-heat treatable aluminum base alloy is formed into useful shapes by compacting under vacuum a powder composed of particles produced by rapid solidification of the alloy to obtain a compacted billet; forming said billet into rolling stock at a temperature ranging from incipient forming temperature to about 500° C.; and rolling the stock to reduce the thickness thereof by subjecting the stock to at least one rolling pass, the stock having a percent thickness per pass ranging up to about 25 percent and a stock temperature ranging from about 230° C. to about 500° C.

22 Claims, 2 Drawing Sheets

THERMOMECHANICAL PROCESSING OF RAPIDLY SOLIDIFIED HIGH TEMPERATURE AL-BASE ALLOYS

FIELD OF THE INVENTION

The present invention relates to dispersion strengthened aluminum-base alloys, and more particularly to methods of producing forged, extruded and rolled rapidly solidified high temperature aluminum-base alloys having improved ambient and elevated temperature mechanical properties.

DESCRIPTION OF THE PRIOR ART

In recent years the aerospace industry has searched for high temperature aluminum alloys to replace titanium and existing aluminum-base alloys in applications requiring operating temperatures approaching 350° C. While high strength at ambient and elevated temperatures is a primary requirement, certain design applications mandate that candidate alloys also exhibit, in combination, ductility, toughness, fatigue and corrosion resistance, as well as lower density than the materials currently being used. In addition to the scientific requirements to be met in developing such alloys, stringent economic requirements must be met in the fabrication of such alloys into useful forms. In many cases, potential savings gained by direct alloy substitution are offset by the complexity and magnitude of forming operations necessary for fabricating desired shapes. It would be particularly advantageous if a high temperature aluminum-base alloy could be easily shaped into desired forms with existing equipment, thereby eliminating the additional expenses associated with retooling or re-designing equipment for fabrication.

For any forming process to be successful, parts fabricated therefrom must demonstrate mechanical properties which are reproducible. The mechanical properties must be attainable under a practical range of forming conditions and are substantially affected by fabrication parameters.

To date. the majority of aluminum-base alloys being considered for elevated temperature applications are produced by rapid solidification. Such processes typically produce homogeneous materials, and permit control of chemical composition by providing for incorporation of strengthening dispersoids into the alloy at sizes and volume fractions unattainable by conventional ingot metallurgy. Processes for producing and chemical compositions of aluminum base alloys for elevated temperature applications have been described in U.S. Pat. No. 2,963,780 to Lyle, et al.; U.S. Pat. No. 2,967,351 to Roberts, et al.; U.S. Pat. No. 3,462,248 to Roberts, et al.; U.S. Pat. No. 4,379,719 to Hildeman, et al. U.S. Pat. No. 4,347,076 to Ray, et al., U.S. Pat. No. 4,647,321 to Adam, et al. and U.S. Pat. No. 4,729,790 to Skinner, et al. The alloys taught by Lyle, et al., Roberts, et al. and Hildeman, et al. were produced by atomizing liquid metals into finely divided droplets by high velocity gas streams. The droplets were cooled by convective cooling at a rate of approximately $10^{4}$° C./sec. Alternatively, the alloys taught by Adam, et al., Ray, et al. and Skinner, et al. were produced by ejecting and solidifying a liquid metal stream onto a rapidly moving substrate. The produced ribbon is cooled by conductive cooling at rates in the range of $10^{5}$° to $10^{7}$° C./sec. In general, the cooling rates achievable by both atomization and melt spinning greatly reduce the size of intermetallic dispersoids formed during the solidification. Furthermore, engineering alloys containing substantially higher quantities of transition elements are able to be produced by rapid solidification with mechanical properties superior to those previously produced by conventional solidification processes.

To achieve the advantages afforded by rapid solidification processing, the powders must be fabricated into a final shape by a series of steps including degassing, compaction, consolidation and forming. Sheet or plate is fabricated by extrusion or forging, followed by machining prior to rolling. Selection of conditions for each step is highly critical since the majority of candidate aluminum base-alloys are non-heat treatable, i.e., dispersoids present in the aluminum matrix may not be completely re-dissolved and subsequently re-precipitated during a suitable thermal treatment. Thus, excessive processing temperatures and times will seriously degrade the mechanical properties of the final part.

The need remains in the art for a process for forming rapidly solidified, dispersion strengthened non heat treatable aluminum base alloys into useful shapes.

SUMMARY OF THE INVENTION

The present invention provides a process for forming a dispersion strengthened, non heat treatable, aluminum base alloy into useful shapes such as bars, sheets, plate, profiled extrusions, near net shape forgings and the like. It has been found that the shaping of these alloys requires selection of thermomechanical processing conditions at which the dispersed strengthening phase remains thermodynamically stable and does not result in loss of mechanical properties. Moreover, selection of processing steps that may be performed on existing equipment will greatly improve the economy in material usage, labor and time. The ability to roll on existing mills with few, if any, modifications or additions necessary, e.g., modifications to the mill to handle small heated rolling preforms or, if hot rolling on a mill with heated rolls is required, machining of the rolls to correct for uneven expansion, is a major advantage in reducing costs.

In one aspect, the present invention provides a process for producing a rolled product comprising the steps of:

a. compacting under vacuum a powder composed of particles produced by rapid solidification of said alloy to obtain a compacted billet having sufficient density to be formed into rolling stock of substantially full density:

b. forming said billet into rolling stock at a temperature ranging from the incipient forming temperature to about 500° C.;

c. rolling said stock to reduce the thickness thereof by subjecting the stock to at least one rolling pass, said stock having a percent thickness reduction per pass ranging up to about 25 percent and a stock temperature ranging from about 230° C. to about 500° C.

In another aspect, the invention provides a process for producing a forged product wherein a billet, compacted as before to sufficient density to be formed into a forging of substantially full density, is then forged at a stock temperature ranging from the incipient forging temperature to about 500° C.

In yet another aspect, the invention provides a process for producing an extruded product, wherein the billet, compacted to sufficient density for forming into an extrusion of substantially full density, is then extruded at a stock temperature ranging from the incipient extruding temperature to about 500° C.

In general, the products produced by the process of the invention maintain excellent mechanical properties, including high strength and ductility at ambient as well as elevated temperatures. Advantageously, the products produced by the process of the invention are substantially defect free. That is to say, the rolled products exhibit little or no rolling defects such as edge cracking, edge waviness, zipper breaks, center split and alligatoring, of the type described in the Metals Handbook, 8th Ed., Vol. 4 (1969). Forging defects such as edge and internal cracking as well as cold shuts are substantially reduced. Extrusion defects such as surface cracks, center split and the like are virtually eliminated.

Alloys preferred for use in the process of our invention are the high temperature aluminum alloys disclosed in U.S. patent application Ser. No. 96,293, filed Sept. 8, 1987 by Adam et al.

It has been found, in accordance with the invention, that defect free high temperature aluminum-iron-vanadium-silicon alloys may be fabricated into sheet of varying thickness characterized by improved strength and ductility by rolling on an unmodified rolling mill under a narrow range of controlled conditions. This process eliminates the additional costs associated with machining the rolls to correct for non-uniform expansion of heated rolls and provision that the rolls be parallel. It has further been found that controlling the extrusion and/or forging conditions of the rolling preform makes possible a wider range of conditions under which the material can be rolled without significant affect on mechanical properties. This substantially increases the number of alloys that can be processed in accordance with the present invention and improves the reproducibility of the rolled sheet. Surprisingly, the temperatures at which the alloys can be rolled in accordance with the process of the invention have a lower temperature range than would be expected in light of teaching by prior art on the rolling of rapidly solidified high temperature aluminum base alloys.

BRIEF DESCRIPTION OF THE DRAWINGS

The invention will be more fully understood and further advantages will become apparent when reference is made to the following detailed description of the preferred embodiment of the invention and the accompanying drawings, in which.

DESCRIPTION OF THE PREFERRED EMBODIMENTS

Figure 1A:
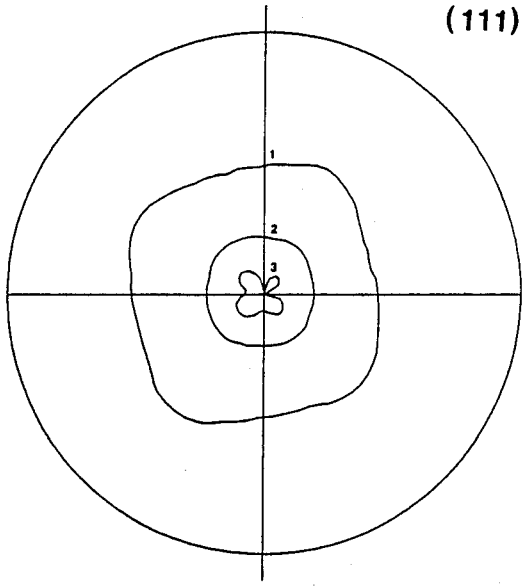
FIGS. 1*a* and 1*b* are X-ray (111) and (200) pole figures, respectively of an aluminum-iron-vanadium-silicon alloy sheet indicating that no significant texture is produced by rolling at 400° C.

The present invention provides a process for producing a rolled product composed of a dispersion strengthened, non-heat treatable, aluminum base alloy comprising the steps of compacting under vacuum a powder composed of particles produced by rapid solidification of said alloy to obtain a compacted billet having sufficient density to be formed into rolling stock of substantially full density: forming said billet into rolling stock at a temperature ranging from the incipient forming temperature to about 500° C., and rolling said stock with the percent reduction in thickness per pass not exceeding 20%, at a temperature in the range of about 230° C. up to about 500° C., with the proviso that for maximizing strength the extrusion or forging, and rolling are carried out at the lower end of the extrusion or forging and rolling temperature ranges, respectively. Moreover, rolling may be performed on mills where the roll temperature is below about the stock temperature and preferably within a range of about 25° C. to 100° C.

In contrast to conventional practice, wherein degassing is performed at a temperature equal to or higher than any temperature to be subsequently experienced by the alloy, the degassing step of the process of this invention is conducted at a substantially lower temperature, preferably ranging from about 300° C. to about 400° C. Compaction of the alloy is carried out at least to the extent that the porosity is isolated, and preferably to at least 95% of full density and higher.

By incipient extrusion and forging temperature is meant the lowest possible temperature at which a given alloy can be extruded or forged on a given extrusion or forging press at a given extrusion ratio or forging reduction, respectively. The extrusion ratio is at least 3:1 and may range, for example, to about 20:1 and higher. The percent reduction per forging step is at least 5% and may range, for example, to about 40% and higher.

In describing the mill practices employed, the extrusion ratio referred to herein represents the ratio of the starting cross-sectional area of the compacted billet to the cross-sectional are of the extruded product. The percent reduction referred to herein is calculated by subtracting the reduced thickness from the original thickness before the first of any specific reduction, dividing that difference by the original thickness and multiplying by one hundred to obtain the percentage of reduction.

In a preferred embodiment, alloys in the present invention involve rapidly solidified aluminum alloys described in U.S. application Ser. No. 96,293, filed Sept. 18, 1987, which alloys consist essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio {Fe+X}:Si ranges from about 2.0:1 to 5.0:1.

To provide the desired levels of strength, toughness and ductility needed for commercially useful applications, the alloys of the invention were rapidly solidified at cooling rates sufficient to greatly reduce the size of the intermetallic dispersoids formed during the solidification as well as allow for substantially higher quantities of transition elements to be added than possible by conventional solidification processes. The rapid solidification process is one wherein the alloy is placed into a molten state and then cooled at a quench rate of at least about $10^5$ to $10^7$° C./sec to form a solid substance. Preferably this method should cool the molten metal at a rate of greater than about $10^6$° C./sec, i.e., via melt spinning, splat cooling or planar flow casting, which forms a solid ribbon. These alloys have an as-cast microstructure which varies from a microeutectic to a microcellular structure, depending on the specific alloy chemistry. In the present invention, the relative proportions of these structures are not critical.

Ribbons of said alloy are formed into particles by conventional comminution devices such as a pulverizer, knife mills, rotating hammer mills and the like. Preferably, the comminuted powder particles have a size ranging from about −40 mesh to about −200 mesh, U.S. standard sieve size.

The particles may then be canless vacuum hot pressed at a temperature ranging from about 275° C. to 550° C., preferably ranging from about 300° C. to 500° C., in a vacuum less than $10^{-4}$ torr ($1.33\times10^{-2}$ Pa), preferably less than $10^{-5}$ torr ($1.33\times10^{-3}$ Pa), and then compacted in a blind die. Those skilled in the art will appreciate that compaction may also be performed by placing the comminuted powder in metal cans, such as aluminum cans having a diameter as large as 30 cm or more, hot degassed in the can under the aforementioned conditions, sealed therein under vacuum, and then thereafter re-heated within the can and compacted to full density, the compacting step being conducted, for example, in a blind die extrusion press. In general, any technique applicable to the art of powder metallurgy which does not invoke liquefying (melting) or partially liquefying (sintering) the matrix metal can be used. Representative of such techniques are explosive compaction, cold isostatic pressing. hot isostatic pressing and conforming.

Consolidation in the present invention includes initially extruding and/or forging a compacted billet into a suitable rolling preform dimension and then rolling into sheet. Extrusion and/or forging of the material not only ensures that the billet is fully dense, but also breaks up surface oxide inherent to the aluminum powder. The extrusion and forging temperatures are critical and within a narrow range. Likewise, extrusion ratio, percent reduction per forging step, lubrication as well as extrusion and forging die type, (i.e., shear-faced or conical-faced extrusion die type, open or closed die forging), and die temperature are critical to realize maximum mechanical properties.

By a shear-faced die is meant a die in which the transition from the extrusion liner to the extrusion die is abrupt. The angle of the head of the die with the liner is approximately 90°, with the exception of the small radius of curvature present at the head of the die from machining and normal wear. By a conical-faced die is meant a die in which the transition from the extrusion liner to the extrusion die is gradual. The angle of the head of the die with the liner is less than about 60°, and preferably it is about 45°. In general, the amount of adiabatic heating that occurs during extrusion, i.e., heat that is generated due to friction of the compact and the die surface as well as that generated by internal friction due to plastic deformation, is greater for extruding through a shear-faced die.

The extrusion temperature is selected so that the maximum temperature the billet sees during extrusion is no greater than 100° C. below the solidus temperature of the alloys, which is about 660° C. This temperature includes the rise in temperature resulting from adiabatic heating in the die occurring during extrusion. Typically extrusion will be carried out in the range of about the incipient extrusion temperature to about 500° C., preferably above about the incipient extrusion temperature to about 380° C., and, most preferably above about the incipient extrusion to about 340° C. The slightly broader range of temperatures than might be expected is based on extrusion trials performed on alloys with varying amounts of the strengthening dispersoid which result in significant differences in mechanical strength and resistance to extrusion at elevated temperatures. In general, the temperatures should range from the incipient extruding temperature, or that which is high enough to allow the extrusion to be pushed through the die at a reasonable pressure. Typically this will be above about 230° C. for alloy designed to replace titanium and other aluminum-based alloys for elevated temperature applications. By extruding above 230° C., there is greater flexibility in conditions which may be employed during subsequent rolling operations. This flexibility is decreased as extrusion temperature is increased.

Extrusion may be carried out in a conical—or shear-faced die as defined above. Lubrication is applied to the die and/or the compacted billet. The lubricants, which aid in the extrusion operation, must be compatible with the alloy and the extrusion press, e.g., liner and die. The lubricant applied to the billet protects the billet from the lubricant applied to the extrusion press. Properly formulated lubricants for specific metals are well known to those familiar with the art. Such lubricants prevent corrosion or oxidation of the billet at the extrusion temperatures being employed and may largely reduce the amount of breakthrough and running pressure required to initiate and maintain extrusion of the billet, and therefore, significantly reduce the amount of adiabatic heating that may occur during extrusion, and thus, mitigate the degradation of mechanical properties. Examples of such lubricants for aluminum-base billets are kerosene, mineral oil, fat emulsion and mineral oil containing sulfurized fatty oils. Filler such as chalk, sulfur and graphite may be added. An example of a lubricant for an extrusion press is colloidal graphite carried in oil or water, molydisulfide, boron sulfide, and boron nitride.

The extruded bar which may range in varying thickness and width is then in a condition to be used as a final extruded product or as a rolling preform. To improve handling during rolling, the width should be as large as possible, however, not greater than 5 centimeters less than the diameter of the compacted billet to assure full densification and fracture of surface oxide of the aluminum-base powder particles following extrusion. The extruded bar may then be machined to any desired length not to exceed the maximum allowable width of the rolling mill. Surface imperfections may also be machined off if necessary.

As defined above, forging may be performed in addition with or alternatively to extrusion to fabricate final forged products or rolling preforms. Forging of the compacted billet provides the principal advantage that single preforms of much larger volumes may be formed directly from a compacted billet and one skilled in the art of rolling will therefore, not be limited to the size of the sheet one may produce by rolling, by the size, and in particular, the width of the rolling preform which may be the case for rolling extruded preform bars.

In general, forged aluminum alloys of the present invention will benefit from forging temperatures being as low as possible consistent with the alloy composition and equipment. As in the extrusion step, it is believed that for high strength forging should be performed at a temperature below one where a decrease in strength will occur. In the present invention, the forging temperature is no greater than 100° C. below the solidus temperature of the alloys which is about 660° C. This temperature includes the rise in temperature resulting from adiabatic heating occurring during the forging operation. Typically, forging will be performed in the range of about the incipient forging temperature to about 500° C., preferably about the incipient forging temperature to about 290° C. Temperatures slightly higher than preferred for the extrusion practices defined above are required to minimize forging defects such as edge and internal cracking as well as cold shuts. Despite the fact that forgeability may increase with temperature, the higher forging temperatures have now been found to have an adverse effect on strength. By forging at temperatures below 450° C., there is little or no significant reduction in the material's mechanical properties and subsequently, there is greater flexibility in conditions which may be employed during rolling operations. This flexibility is decreased as forging temperature is increased.

Forging is typically performed in a multi-step operation where the percent reduction per forging step is at least 5% and may range, for example, to about 40% and higher. Forging may be conducted using a die having a die temperature substantially the same as the temperature of stock appointed to be forged. Generally the die is a closed die in which lateral spreading is physically constrained by an encircling die wall. The forging step may also be conducted using an open die in which there is no physical containment of lateral spread. Edge cracks which may form are typically small and may be machined off prior to rolling.

Lubrication is applied to both the die and the compacted billet. The lubricants, which aid in the forging operation, must be compatible with the alloy and the forging press, e.g., pistons and die. The lubricant applied to the billet protects the billet from the lubricant applied to the forging press. Properly formulated lubricants for specific metals are well known to those familiar with the art. Such lubricants prevent corrosion or oxidation of the billet at the forging temperatures being employed and may largely reduce the friction and edge cracking that results from significant lateral spreading and intimate contact between the billet and the top and bottom pistons during forging. Examples of such lubricants for aluminum-base billets are kerosene, mineral oil, fat emulsion, mineral oil containing sulfurized fatty oils and graphite foil. Filler such as chalk, sulfur and graphite may be added. An example of a lubricant for a forging press is colloidal graphite carried in oil or water, molydisulfide, boron sulfide, and boron nitride.

The forging may have a wide range of thickness and diameter depending on the shape and size of the forged product. Typically forgings produced in accordance with the process of the invention have thickness ranging from about 1 centimeter to 1 meter and thicker. The diameter and thickness of the forging are functions of press capacity. Diameter of the forging can range from about 1 centimeter to about 3 meters and more. Following machining into a rectangular section, the forging is ready to be rolled. Surface imperfections may also be removed by machining, if necessary.

Preferably, rolling preformed billets of the aluminum alloys of the present invention will benefit most by rolling at temperatures as low as possible consistent with the alloy composition and equipment. As in the case for the extrusion and forging operations defined above, rolling temperature is selected to be below one where a decrease in strength will occur and in a lower range than would be expected from conventional practices known in the art. Typically rolling will be performed in the range of about 230° C. to 500° C., preferable above about 230° C. and to about 330° C. Despite the fact that rollability may increase with temperature, the higher rolling temperatures have now been found to have an adverse affect on strength.

Depending on required thickness, rolling is typically performed in a single or multi-step operation where for the latter operation, the percent reduction per rolling step is at least 5% and may range, for example, to about 25%. Less edge cracking is observed where the percent reduction per pass is below 10%. In a multi-step rolling operation it has been found that it is the initial step that is critical in initiating material flow and spreading deformation throughout the thickness of the rolling preform. If necessary, cross rolling, to expand the material's width, should be performed in the first few passes of the rolling operation. Adherence to this practice will greatly reduce the propensity to form zipper cracks or center split in the rolled sheet.

Contrary to conventional practice in the art of rolling rapidly solidified high temperature aluminum-base alloys, rolling may be performed on a mill having roll temperatures below the stock temperature (usually in excess of 230° C.) and, preferably, at temperatures ranging from about 25° C. to about 100° C. This process allows rolling to be performed on conventional rolling mills and precludes the necessity to make modifications to the mill to heat the rolls, either by induction or convective heating, as well as the excessive costs associated with the complex machining of the rolls to correct for non-uniform expansion during heating and the provision that the rolls gap be parallel.

Depending on the alloy composition and rolling temperature, lubrication may be applied to the rolls. The lubricants, which aid in the rolling process must be compatible with the alloy and the rolling mill. The lubricant applied to the rolls prevents the sheet from sticking to the rolls and assists material flow during the rolling pass. Hence the propensity for edge cracking or alligatoring is reduced. Properly formulated lubricants for specific metals are well known to those familiar with the art. Examples of such lubricants for aluminum-base sheet are kerosene, mineral oil, fat emulsion and mineral oil containing sulfurized fatty oils.

In conversions from °F. to °C., the temperatures were rounded off, as were the conversions from ksi to MPa and inches to centimeters. Also, alloy compositions disclosed herein are nominal. With respect to conditions, for commercial production it is not practical or realistic to impose or require conditions extant in a research laboratory facility. Temperatures may very, for example, by 25° C. of the target temperature disclosed herein. Thus, having a wider window for processing conditions adds to the practical value of the process.

This invention is further described herein, but is not limited by the examples given below. In all examples the test samples were fabricated from dispersion strengthened alloys comprising aluminum, iron, vanadium and silicon in the concentrations defined in U.S. application Ser. No. 96,293, filed Sept. 18, 1987, and prepared from rapidly solidified powders by the compaction and fabrication techniques described above. The specific techniques, conditions, materials, proportions and reported data set forth to illustrate the principles of the invention are exemplary and should not be construed as limiting the scope of the invention.

EXAMPLE I

Thirty-Seven hundred grams of −40 mesh (U.S. standard sieve) powder of the nominal composition aluminum-balance, 1.36 at. % iron, 0.14 at. % vanadium, 0.53 at. % silicon, (hereinafter designated alloy FVS0301), aluminum-balance, 2.73 at. % iron, 0.27 at. % vanadium, 1.05 at. % silicon, (hereinafter designated alloy FVS0611), aluminum-balance, 4.33 at. % iron, 0.73 at. % vanadium, 1.72 at. % silicon, (hereinafter designated alloy FVS0812) and aluminum-balance, 6.06 at. % iron, 0.65 at. % vanadium, 2.47 at. % silicon, (hereinafter designated alloy FVS1212) were produced by comminuting rapidly solidified planar flow cast ribbon. Each batch was then hot pressed at about 400° C. in a vacuumm less than about $10^{-5}$ torr ($1.33\times10^{-3}$ Pa) into a billet having a diameter of approximately 10.9 cm. Billets of alloys FVS0301, FVS0611 and FVS0812 were heated to a temperature of about 385° C. and extruded through tool steel dies heated to a temperature of about 300° C. to form 0.95 cm×5.6 cm flat bar. Billets of alloy FVS1212 were heated to a temperature of about 425° C. and extruded through tool steel dies heated to a temperature of about 300° C. to form 0.95 cm×5.6 cm flat bar. Extruded bars were then subjected to tensile tests at room and elevated temperatures to determine their tensile properties, including values of 0.2% yield strength (Y.S.), ultimate tensile strength (U.T.S.) and percent (%) elongation (ductility). Testing was performed on an Instron Model 1125 tensile machine. The results of room and elevated temperature tensile tests performed on specimens conforming to ASTM standard #B-557M and #E-21, respectively, machined from extruded bar are set forth in Table I. Each data value listed in Table I represents the average of duplicate tests performed on three separate extrusions of the same alloy, i.e., six total.

As shown by the data in Table I, all of the alloys demonstrate very desirable combinations of strength and ductility. Alloy FVS0301 demonstrates the lowest average values of 0.2% yield and ultimate tensile strengths, yet the highest average values of percent ductility.

TABLE I

AMBIENT TEMPERATURE TENSILE PROPERTIES FOR EXTRUDED BAR OF ALUMINUM-BASE ALLOYS FVS0301, FVS0611, FVS0812 AND FVS1212

| Alloy Designation | Test Temp. (°C.) | Y.S. (MPa) | U.T.S. (MPa) | Elong. (%) |
|---|---|---|---|---|
| FVS0301 | 25 | 167 | 217 | 27 |
| " | 149 | 143 | 165 | 24 |
| " | 232 | 125 | 134 | 23 |
| " | 316 | 105 | 107 | 24 |
| FVS0611 | 25 | 258 | 311 | 22 |
| " | 149 | 223 | 248 | 14 |
| " | 232 | 192 | 205 | 17 |
| " | 316 | 160 | 163 | 17 |
| FVS0812 | 25 | 390 | 447 | 12 |
| " | 149 | 337 | 369 | 9 |
| " | 232 | 293 | 310 | 11 |
| " | 316 | 231 | 238 | 12 |
| FVS1212 | 25 | 513 | 553 | 9 |
| " | 149 | 436 | 457 | 6 |
| " | 232 | 373 | 390 | 7 |
| " | 316 | 272 | 290 | 9 |

by comparison, alloy FVS1212 demonstrates the highest average values and ultimate tensile strengths, yet the lowest average percent ductility. Variations in strength among the four alloys examined are solely due to differences in chemical composition and volume fraction of the strengthening dispersoids, and are not reflective of minor differences in processing conditions. These data values are considered representative of base-line mechanical properties to which any further mechanical testing, either after thermal exposure or thermomechanical treatment, e.g., rolling of sheet, should be compared.

EXAMPLE II

One thousand grams of −40 mesh (U.S. standard sieve) powder of alloys FVS0812 and FVS1212 were produced by comminuting rapidly solidified planar flow cast ribbon. Each batch was then hot pressed at about 375° C. in a vacuum less than about $10^{-5}$ torr ($1.33\times10^{-3}$ Pa) into a billet having a diameter and height of approximately 7.6 cm and 7.6 cm, respectively. Multiple billets of these two alloys were forged at temperatures of 400° C., 450° C. and 500° C. in tool steel dies which were heated to the same temperature as the billet. Forging was performed in a series of five steps, accomplishing equal percentages of reduction in height. The first four steps involved closed die forging operations providing, respectively, 20%, 25%, 33% and 50% reduction per forging step. The final step was performed in an open die and involved a 50% reduction in height to a final thickness of 1.9 cm. Billets were re-heated for approximately 0.25 hours in-between forging operations to maintain the initial desired forging temperature. The final billet dimension was approximately 15.3 cm in diameter by approximately 1.9 cm thick.

Forged billets were then subjected to tensile tests at room temperature to determine the effect of forging temperature on tensile properties, including values of 0.2% yield strength (Y.S.), ultimate tensile strength (U.T.S.) and percent (%) elongation (ductility). Testing was performed on an Instron Model 1125 tensile machine. The results of tensile tests performed on specimens conforming to ASTM standard #B-557M machined from forged plate are set forth in Table II. Each data value listed in Table II represents an average of at least duplicate tests performed on three separate forgings of the same alloy forged at the same temperature.

TABLE II

AMBIENT TEMPERATURE TENSILE PROPERTIES FOR FORGED PLATE OF ALUMINUM-BASE ALLOYS FVS0812 AND FVS1212

| Alloy Designation | Test Temp. (°C.) | Forging Temp. (°C.) | Y.S. (MPa) | U.T.S. (MPa) | Elong. (%) |
|---|---|---|---|---|---|
| FVS0812 | 25 | 400 | 411 | 436 | 12 |
| " | 25 | 450 | 399 | 427 | 11 |
| " | 25 | 500 | 365 | 399 | 15 |
| FVS1212 | 25 | 400 | 512 | 531 | 11 |
| " | 25 | 450 | 493 | 521 | 11 |
| " | 25 | 500 | 485 | 520 | 7 |

As shown by the data of Table II, an increase in forging temperatures from 400° C. to 500° C. for either alloy results in a significant decrease in tensile strength. By comparison with data shown in Table I for extruded material, forging both alloy FVS0812 and FVS1212 at 400° C. does not promote a significant decrease in strength.

EXAMPLE III

Thirty-Seven hundred grams of −40 mesh (U.S. standard sieve) powder of the compositions aluminum-balance, 4.33 at. % iron, 0.73 at. % vanadium, 1.72 at. % silicon, (hereinafter designated alloy FVS0812) was produced by comminuting rapidly solidified planar flow cast ribbon. The powder was then hot pressed at about 375° C. in a vacuum less than about $10^{-5}$ torr ($1.33\times10^{-3}$ Pa) into a billet having a diameter of approximately 10.9 cm. The billet of alloy FVS0812 was heated to a temperature of about 385° C. and extruded through a tool steel die heated to a temperature of about 300° C. to form a 0.95 cm×5.6 cm flat bar. To evaluate the effect of isothermal exposure on mechanical properties, tensile tests at ambient temperature after exposure for varying lengths of time at 425° C., 450° C., 475° C., 500° C., 550° C. and 600° C. were performed to evaluate the effect of isothermal exposure on tensile properties. Testing was performed on an Instron Model 1125 tensile machine. The results of tensile tests performed on specimens conforming to ASTM standard #B-557M machined from the extruded bar are set forth in Table III. Each data value listed in Table III represents the average results of duplicate tests.

As shown by the data of Table III, isothermal exposure to temperatures at or below about 450° C. has little, if any, deleterious affect on ambient tensile properties. At temperatures in excess of 450° C. there is a continual decrease in tensile properties, even after only 24 hours of exposure.

TABLE III

TENSILE PROPERTIES FOR EXTRUDED BAR OF ALLOY FVS0812 AFTER ELEVATED TEMPERATURE EXPOSURE

| Condition or Exposure Temp. (°C.) | Time (hrs.) | Test Temp. (°C.) | Y.S. (MPa) | U.T.S. (MPa) | Elong. (%) |
|---|---|---|---|---|---|
| As-Extruded | | 25 | 400 | 455 | 12 |
| 425 | 1000 | 25 | 407 | 451 | 12 |
| 450 | 100 | 25 | 407 | 451 | 10 |
| 475 | 100 | 25 | 379 | 427 | 9 |
| 500 | 100 | 25 | 345 | 393 | 10 |
| 550 | 24 | 25 | 351 | 399 | 9 |
| 550 | 100 | 25 | 290 | 372 | 7 |
| 600 | 24 | 25 | 276 | 345 | 5 |

EXAMPLE IV

Flat extruded samples, 0.95 cm×5.6 cm×13 cm, of alloys FVS0301, FVS0611, FVS0812 and FVS1212 produced in Example I were rolled on a Stannett rolling mill at temperatures of about 300° C., 400° C. and 500° C. The rolls were maintained at similar temperatures to within 10° C. during the rolling operation by resistance heaters situated within the rolls. Prior to rolling samples were heated at 300° C., 400° C. and 500° C. for one hour. Rolling was performed in a multi-step operation with a uniform 0.05 cm reduction per pass until a final thickness of 0.25 cm was achieved. These reductions correspond to percent reductions in the range of about 5 to 15%. Samples were re-heated between rolling passes for 0.25 hrs. to maintain the desired rolling temperature.

To evaluate the effect of rolling temperature on mechanical properties, tensile tests at ambient temperature of rolled sheet were performed. Testing was performed on an Instron Model 1125 tensile machine. The results of tensile tests performed on specimens oriented normal (long transfer, LT) to the rolling direction and conforming to ASTM standard #B-557M are set forth in Table IV. Each data value listed in Table IV represents an average of duplicate tests.

TABLE IV

AMBIENT TENSILE PROPERTIES FOR ROLLED SHEET OF ALLOYS FVS0301, FVS0611, FVS0812 AND FVS1212 AFTER ROLLING AT 300° C., 400° C. AND 500° C.

| Alloy | Condition or Rolling Temperature (°C.) | Y.S. (MPa) | U.T.S. (MPa) | Elong. (%) |
|---|---|---|---|---|
| FVS0301 | As-Extruded | 167 | 217 | 27 |
| " | 300 | 175 | 209 | 23 |
| " | 400 | 134 | 181 | 31 |
| " | 500 | 91 | 164 | 34 |
| FVS0611 | As-Extruded | 258 | 311 | 22 |
| " | 300 | 289 | 324 | 23 |
| " | 400 | 175 | 227 | 14 |
| " | 500 | 113 | 188 | 33 |
| FVS0812 | As-Extruded | 390 | 447 | 17 |
| " | 300 | 426 | 459 | 13 |
| " | 400 | 398 | 421 | 17 |
| " | 500 | 263 | 357 | 19 |
| FVS1212 | As-Extruded | 513 | 553 | 9 |
| " | 300 | 500 | 530 | 9 |
| " | 400 | 490 | 508 | 13 |
| " | 500 | 420 | 453 | 13 |

As shown by the data of Table IV, rolling temperature has a very large influence on tensile properties of the rolled sheet. Each alloy exhibits a comparable decrease in strength as rolling temperatures are increased from 300° C. to 500° C. Rolling performed at 300° C. is observed to have little, if any, effect on mechanical properties when compared to the mechanical properties produced by extrusion, listed in Table IV. In fact, rolling at 300° C. results in a slight increase in ultimate tensile strength for alloys FVS0611 and FVS0812.

EXAMPLE V

Flat samples, 10 cm×10 cm×1.9 cm, of alloys FVS0812 and FVS1212 machined from forgings produced in Example II were rolled on a Stannett rolling mill at temperatures of about 400° C., 450° C. and 500° C. The rolls were maintained at similar temperatures to within 10° C. during the rolling operation by resistance heaters situated within the rolls. Prior to rolling samples were heated at 400° C., 450° C. and 500° C. for one hour. Rolling was performed in a multi-step operation with about a uniform 0.075 cm reduction per pass until a final thickness of 0.25 cm was achieved. These reductions correspond to percent reductions in the range of about 5 to 25 percent. Samples were re-heated between rolling passes for 0.25 hrs. to maintain the desired rolling temperature.

To evaluate the effect of rolling temperature on mechanical properties, tensile tests at ambient temperature of rolled sheet were performed. Testing was performed of an Instron Model 1125 tensile machine. The results of tensile tests performed on specimens oriented in directions parallel (longitudinal—L) and normal (long transverse—LT) to the rolling direction and conforming to ASTM standard #B-557M are set forth in Table V. Each data value listed in Table V represents an average of duplicate tests.

As shown by the data of Table V, variations in forging and rolling temperatures have a very large influence on the mechanical properties of the rolled sheet.

TABLE V

AMBIENT TEMPERATURE TENSILE PROPERTIES FOR FORGED PLATE AND ROLLED SHEET OF ALUMINUM-BASE ALLOYS FVS0812 AND FVS1212

| Alloy | Forging Temp. (°C.) | Rolling Temp. (°C.) | Orientation* | Y.S. (MPa) | U.T.S. (MPa) | El. (%) |
|---|---|---|---|---|---|---|
| FVS0812 | 400 | None | — | 411 | 436 | 12 |
| " | " | 400 | LT | 379 | 434 | 12 |
| " | " | " | L | 413 | 434 | 15 |
| " | " | ·450 | LT | 358 | 372 | 15 |
| " | " | 500 | LT | 407 | 420 | 16 |
| " | 450 | None | — | 399 | 427 | 11 |
| " | " | 400 | LT | 393 | 420 | 14 |
| " | " | 450 | LT | 393 | 407 | 14 |
| " | " | 500 | LT | 379 | 393 | 16 |
| " | 500 | None | — | 365 | 399 | 15 |
| " | " | 400 | LT | 379 | 393 | 14 |
| " | " | 450 | LT | 386 | 400 | 14 |
| " | " | 500 | L | 393 | 413 | 10 |
| FVS1212 | 400 | None | — | 512 | 531 | 11 |
| " | " | 400 | LT | 503 | 517 | 12 |
| " | " | 450 | LT | 517 | 524 | 12 |
| " | " | 500 | LT | 524 | 537 | 10 |
| " | 450 | None | — | 493 | 521 | 11 |
| " | " | " | LT | 517 | 524 | 10 |
| " | " | " | L | 503 | 510 | 6 |
| " | " | 450 | LT | 496 | 517 | 13 |
| " | " | 500 | LT | 517 | 524 | 12 |
| " | 500 | None | — | 485 | 520 | 7 |
| " | " | 400 | LT | 503 | 517 | 12 |
| " | " | 450 | LT | 496 | 510 | 11 |
| " | " | 500 | LT | 498 | 507 | 10 |

*LT - Long Transverse, normal to rolling direction,
*L - Longitudinal, parallel to rolling direction.

Figure 1B:
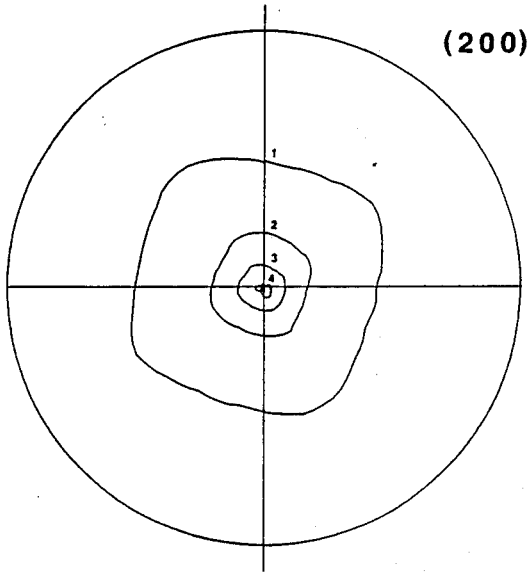

As was observed from rolling trials of extruded bar defined in Example IV, rolling at 400° C. had little, if any, affect on mechanical properties when compared with the mechanical properties of the initial forgings defined in Example II. In general, as rolling temperature was increased, tensile strengths of either alloy FVS0812 or FVS1212 were observed to continually decrease. Furthermore, the effect of rolling temperature appears to have less effect for billets of both alloys forged at 400° C. Based on tensile results of specimens oriented either parallel to the rolling direction (longitudinal, L) or normal to the rolling direction (long transverse, LT), rolling does not appear to promote any excessive texture in the alloy, FIG. 1, nor influence tensile strength and ductility in either orientation. That is to say, the rolled product exhibits substantially isotropic strength and ductility. The strength of the product is substantially equal to the strength of the rolling stock, and the ductility of the rolled product is substantially greater than that of the rolling stock.

EXAMPLE VI

Forty-five kilograms of −40 mesh (U.S. standard sieve) powder of alloy FVS0812 were produced by comminuting rapidly solidified planar flow cast ribbon. Powders were then placed into a 28 cm diameter aluminum can composed of alloy 6061, hot degassed in the can under a vacuum less than $10^{-4}$ torr ($1.33\times10^{-2}$ Pa) at a temperature of 350° C., and sealed therein under vacuum. The powder was subsequently heated within the can to a temperature of 350° C. and compacted in a blind die extrusion press to full density. The can material was then machined off leaving a billet approximately 25 cm in diameter by 30 cm in length. The compacted billet was then extruded at 390° C. through a shear faced die into a bar with cross-sectional dimensions of about 11.8 cm by about 1.8 cm. Sections of extruded bar were then rolled on a "Fenn" Mill with 76.2 cm diameter rolls at a temperature of about 400° C. Initially, the rolls were heated to about 75° C. and allowed to cool during rolling. The temperature of the rolls for the final few passes remained at about 40° C. The percent of reduction for the first rolling step was approximately 5%. The percent of reduction for subsequent passes was about 15%. Final passes sometimes varied depending on the final sheet thickness and typically fell within the 5 to 15% range.

To evaluate the effect of rolls temperature and sheet thickness, i.e., the number of rolling passes, on mechanical properties, tensile tests were performed on sheet samples machined to ASTM #B-557M standards in both the longitudinal and long transverse orientations. Testing was performed on an Instron Model 1125 tensile machine. The results of tensile tests are set forth in Table VI. Each data value listed in Table VI represents the average of duplicate tests.

Figure 2:
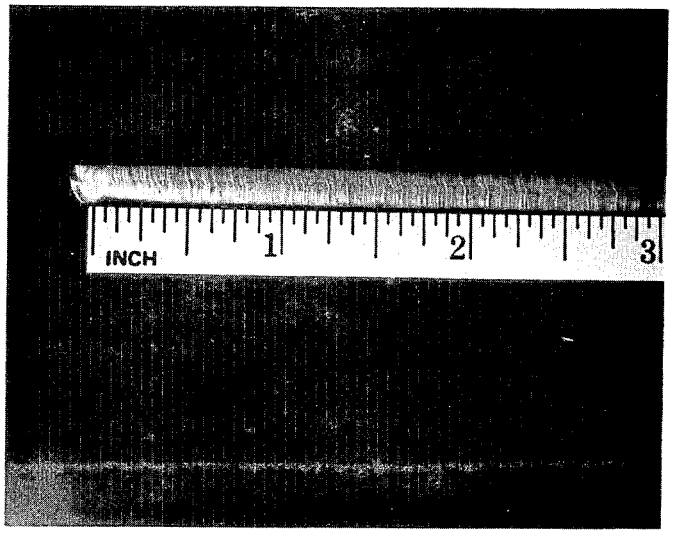
FIG. 2 is a photograph of typical crack-free edge of an aluminum-iron-vanadium-silicon alloy sheet produced by rolling at 300° C.
Figure 3:
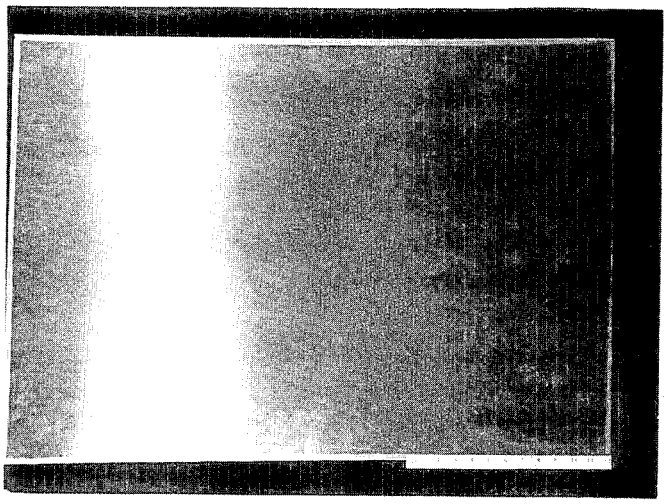
FIG. 3 is a photograph of a defect free aluminum-iron-vanadium-silicon alloy sheet produced by rolling at 300° C.

As shown by the data of Table VI, the effect of rolling on a mill where the roll's temperature was significantly colder than previously used had little, if any, affect on tensile properties when rolled at 400° C. and compared to the tensile data of the original extrusion. The effect of lower rolls temperature on the formation of edge cracking was also insignificant, FIG. 2. Sheet was able to be rolled to the thickness shown in Table VI without any excessive waviness or edge cracking, FIG. 3. Small cracks, if any, which occurred could be easily sheared off. The variation in tensile strengths with sheet thickness indicates that additional passes does result in a slight decrease in strength. Samples of 0.23 cm thick sheet tested in both the longitudinal and long transverse orientations mechanical properties, indicating that there is a lack of preferred texture.

TABLE VI

AMBIENT TEMPERATURE TENSILE PROPERTIES ALLOY FVS0812 SHEET ROLLED AT 400° C.

| Condition or Sheet Thickness (cm) | Orientation* | Y.S. (MPa) | U.T.S. (MPa) | Elong. (%) |
|---|---|---|---|---|
| As-Extruded | L | 378 | 432 | 12.5 |
| " | LT | 375 | 435 | 8.8 |
| 0.23 | L | 406 | 422 | 17.1 |
| " | LT | 390 | 411 | 16.9 |
| 0.16 | LT | 367 | 402 | 14.5 |

*L - Longitudinal Direction, parallel to the rolling direction.
LT - Long Transverse Direction, normal to the rolling direction.

What is claimed:

1. A process for producing a rolled product composed of a dispersion strengthened, non-heat treatable, aluminum base alloy, comprising the steps of:

a. compacting under vacuum a.powder composed.of particles produced by rapid solidification of said alloy to obtain a compacted billet having sufficient density to be formed into rolling stock of substantially full density;

b. forming said billet into rolling stock at a temperature ranging from the incipient forming temperature to about 500° C.;

c. rolling said stock to reduce the thickness thereof by subjecting the stock to at least one rolling pass, said stock having a percent thickness reduction per pass ranging up to about 25 percent and a stock temperature ranging from about 230° C. to about 500° C.

2. A process as recited by claim 1, wherein said forming step is an extrusion step and said extrusion temperature ranges from about the incipient extrusion temperature to about to about 500° C.

3. A process as recited by claim 2, wherein said extrusion temperature ranges from about the incipient extrusion temperature to about 340° C.

4. A process as recited by claim 1, wherein said forming step is a forging step and said forging temperature ranges from about the incipient forging temperature to about 500° C.

5. A process as recited by claim 4, wherein said forging temperature ranges from about the incipient forging temperature to about 290° C.

6. A process as recited by claim 1, wherein said rolling step is conducted using a stock temperature ranging from about 230° C. to about 330° C.

7. A process as recited by claim 1, wherein said rolling pass is conducted with a roll temperature ranging from about 25° C. to about 500° C.

8. A process as recited by claim 1, wherein said rolling pass is conducted with a roll temperature ranging from about 25° C. to below about the stock temperature.

9. A process as recited by claim 1, wherein said rolling pass is conducted with a roll temperature ranging from about 25° C. to about 100° C.

10. A rolled product composed of a dispersion strengthened, non-heat treatable aluminum alloy and having been produced by the process of claim 1.

11. A rolled product as recited by claim 10, having substantially isotropic strength and ductility, said strength being substantially equal to and said ductility being substantially greater than that of said rolling stock.

12. A process for producing a forged product composed of dispersion strengthened, non-heat treatable, aluminum base alloy, comprising the steps of:

a. compacting under vacuum a powder composed of particles produced by rapid solidification of said alloy to obtain a compacted billet having sufficient density to be formed into a forging of substantially full density;

b. forging said billet at a stock temperature ranging from the incipient forging temperature to about 500° C.

13. A process as recited by claim 12, wherein prior to said forging step, said billet is extruded at a temperature ranging from about the incipient extrusion temperature to about 500° C.

14. A process as recited by claim 12, wherein said forging step is conducted at a temperature ranging from about the incipient forging temperature to about 290° C.

15. A process as recited by claim 12, 13 or 14, wherein said forging step is conducted using a die having a die temperature substantially the same as said stock temperature.

16. A forged product composed of a dispersion strengthened, non-heat treatable aluminum alloy and having been produced by the process of claim 12.

17. A process for producing a extruded product composed of a dispersion strengthened, non-heat treatable, aluminum base alloy, comprising the steps of:

a. compacting under vacuum a powder composed of particles produced by rapid solidification of said alloy to obtain a compacted billet having sufficient density to be formed into an extrusion of substantially full density;

b. extruding said billet at a stock temperature ranging from the incipient extruding temperature to about 500° C.

18. A process as recited by claim 17 wherein said extruding step is conducted at a temperature ranging from about the incipient extruding temperature to about 380° C.

19. A process as recited by claim 18, wherein said extruding step is conducted at a temperature ranging from about about the incipient extruding temperature to about 340° C.

20. An extruded product composed of a dispersion strengthened, non-heat treatable aluminum alloy and having been produced by the process of claim 17.

21. A process as recited by claim 1, 12 or 17, wherein said aluminum base alloy has a composition consisting essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, c ranges from 0.05 to 3.5 at % and the balance is aluminum plus incidental impurities, with the proviso that the ratio {Fe+X}:Si ranges from about 2.0:1 to 5.0:1.

22. A process recited by claim 1, 12 or 17, wherein said aluminum base alloy has a composition consisting essentially of 1.36 atom percent iron, 0.27 atom percent vanadium, 1.05 atom percent silicon, the balance being aluminum.

* * * * *